United States Patent [19]

Kuracina

[11] Patent Number: 4,884,560

[45] Date of Patent: Dec. 5, 1989

[54] THERMAL MASSAGE DEVICE

[76] Inventor: Thomas C. Kuracina, 15974 Maricopa Hwy., Ojai, Calif. 93023

[21] Appl. No.: 217,546

[22] Filed: Jul. 11, 1988

[51] Int. Cl.[4] ..... A61H 29/00

[52] U.S. Cl. ..... 128/24.3; 128/24.1

[58] Field of Search ..... 128/24.1–24.3, 128/65, 56, 57, 400

[56] References Cited

U.S. PATENT DOCUMENTS

| | | | |
|---|---|---|---|
| 792,124 | 6/1905 | Evans | 128/65 |
| 896,484 | 8/1908 | Thoms | 128/57 |
| 926,245 | 6/1909 | Coon | 128/24.3 |
| 1,833,105 | 11/1931 | Aronson | 128/24.2 |
| 1,882,370 | 10/1932 | Schroeder | 128/24.3 |
| 2,546,095 | 3/1951 | Gustlin | 128/24.3 |
| 3,637,205 | 1/1972 | Bankston | 128/57 |
| 3,845,758 | 11/1974 | Anderson | 128/56 |
| 4,681,095 | 7/1987 | Bontemps | 128/24.1 |
| 4,760,842 | 8/1988 | Holmes | 128/69 |

FOREIGN PATENT DOCUMENTS

| | | | |
|---|---|---|---|
| 130571 | 2/1929 | Switzerland | 128/24.3 |
| 0135159 | 11/1929 | Switzerland | 128/24.3 |
| 280168 | 10/1928 | United Kingdom | 128/24.3 |

*Primary Examiner*—William Pieprz
*Assistant Examiner*—Huong Q. Pham
*Attorney, Agent, or Firm*—Kenneth J. Hovet

[57] ABSTRACT

A thermal massaging device comprising a hollow rod member rotatably supported by slidable gripping sleeves. The sleeves are located at opposing ends of the rod member and are retained thereon by abutment rings. Closure caps enclose the rod member open ends and may provide enlarged chambers for additional capacity or for housing heating or valve assemblies. One of the caps may be removable for filling the rod member interior with a thermal medium. A handle is used for offset support of the device during filling and additional massaging sleeves may be placed over the rod member for specialized massaging needs.

17 Claims, 4 Drawing Sheets

THERMAL MASSAGE DEVICE

BACKGROUND OF THE INVENTION

1. Field of the Invention

The present invention concerns massage devices and more particularly, to a sleeved roller implement for use with a thermal medium.

2. Description of the Prior Art

Initially, most massaging devices used large diameter rollers having stationary handles similar to a pie dough rolling pin. Subsequent improvements involved making the rollers hollow for containing ice, sand or hot water. Typical of these are U.S. Pat. Nos. 1,270,635; 1,882,370; 2,057,396 and 3,847,144. Some of the more elaborate rollers were heated by electrical means or exothermic chemical reactions.

In an effort to make the rollers more effective and adaptable to the larger muscle groups, longer and narrower rollers were designed. Of particular significance to the present invention are the sleeved rollers shown in U.S. Pat. Nos. 3,637,205 and 4,002,163. The above rollers utilize functional end structures and elongated central sleeves for effecting a massage or exercise means.

A problem with the above structures is that they are not adapted for use with an internal heating medium. Even if the inner shafts were designed to sealingly contain hot fluids, no means is provided for safely and effectively filling the shafts with such fluids. Further, should the inner shafts include a heating means, the central roller sleeves create an extra layer which would inhibit heat transfer.

SUMMARY OF THE INVENTION

The present invention provides an elongated hollow rod member having a mid-portion body massage area. Slidable sleeves are used at opposing ends of the member for manual gripping and moving the massage area against one's body. End caps sealingly engage the ends of the member for retaining a thermal medium within the hollow interior. At least one cap is removable or has a valve means for permitting access to the interior. Also, one end of the member is provided with a handle means for offsetting support of the device when being filled with an unsafe thermal medium.

DESCRIPTION OF THE PREFERRED EMBODIMENTS

Figures 1, 2, 3, 4:
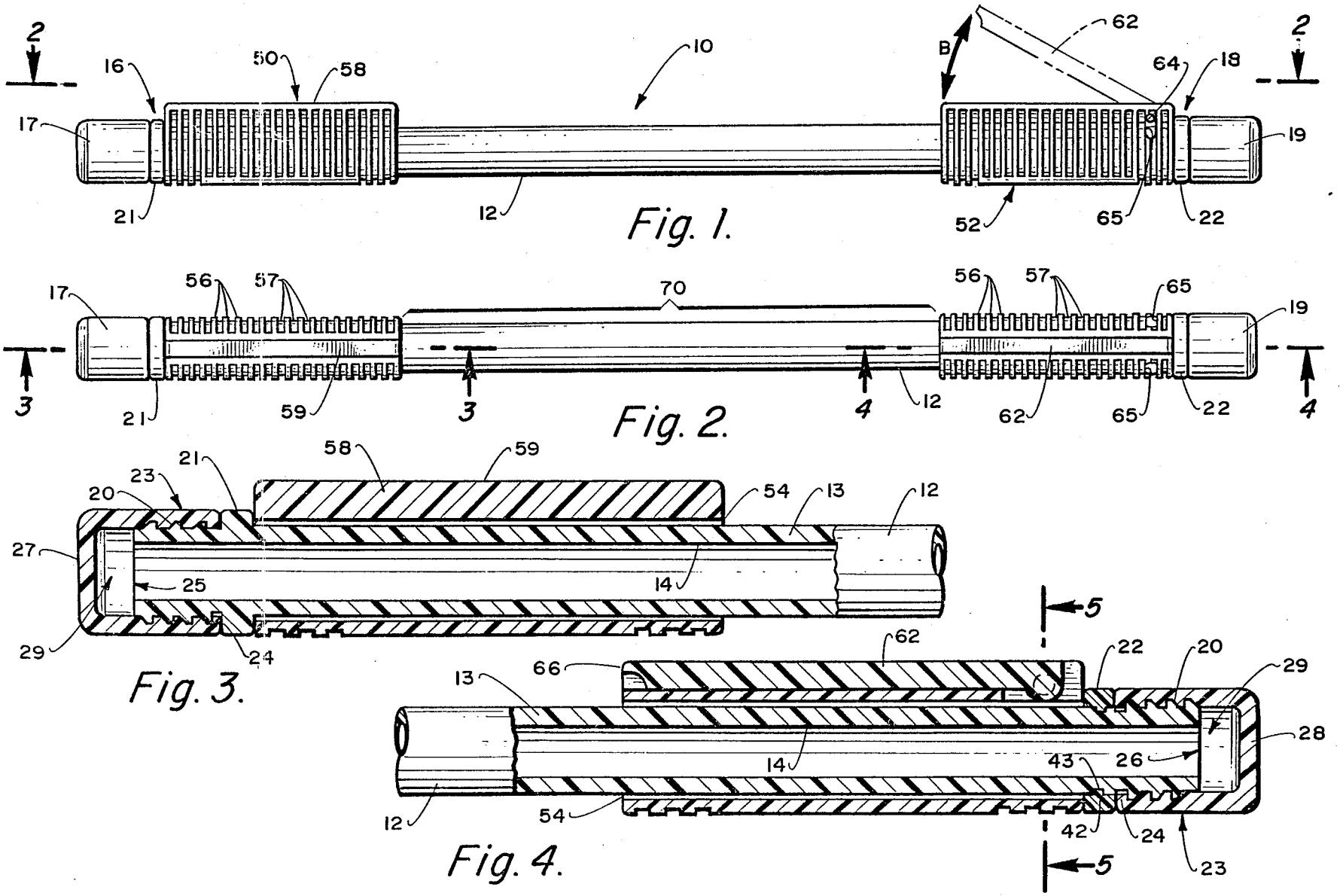
FIG. 1 is a side elevational view of the thermal massage device of the present invention.
FIG. 2 is a top plan view of the device shown in FIG. 1.
FIG. 3 is an enlarged cross-sectional view taken along lines 3—3 of FIG. 2.
FIG. 4 is an enlarged cross-sectional view taken along lines 4—4 of FIG. 2.

The basic elements of the invention are best appreciated by reference to FIGS. 1–6 of the drawings. The overall device 10 comprises an elongated hollow rod member 12. The member has a thermoconductive wall thickness 13 and a hollow interior 14. The hollow interior contains a flowable thermal medium 15 which, as used herein, comprises heat transfer materials such as water, oils, fluid chemical compositions, particulate materials such as sand, crushed ice, powders and the like.

Preferably, the rod member is tubular having a round cross-section and a smooth exterior surface. It has a first end 16 which is sealed with a closure means shown as first closure cap 17. Opposing second end 18 is similarly sealed with second closure cap 19.

With particular reference to FIGS. 3 and 4, both caps are secured to the member with retention means shown as matching threads 20. In the case of plastic materials, the threads provide sufficient resilience to effect a fluid tight seal between the member ends and closure caps. However, various types of gaskets, washers or inner sealing rings may be used. Also, the use of first and second abutment rings 21,22 provide additional sealing areas between the ends of cap skirts 23 and the ring outer face 24.

The rings are offset from each respective opposing end opening 25,26 a predetermined distance sufficient to allow effective cap attachment and sealing. First abutment ring 21 may be molded integrally with the rod member, but second abutment ring 22 must be removable for purposes to be hereinafter described.

It will be appreciated that the closure caps of the invention are adaptable for multiple uses and one or both can be used for additional thermal medium capacity. They may also be modified to provide a valve means, handle means and heating means.

As shown in FIGS. 3 and 4, both closure caps have an end wall 27,28 that is spaced from respective end openings 25,26. This creates chamber areas 29 for containing additional thermal medium and/or heating/sensor apparatus. The chamber size will be dictated by the needs of the above items and separate caps for different purposes may be used interchangeably or in combination.

In FIGS. 11–14, closure cap 19' is shown as including a valve means for extended end 18' of the rod member. The extended end has an enclosed top 39 with a side opening 30. The side opening is surrounded with O-ring 40 for sealing against inner surface 33 of the closure cap.

Figure 11:
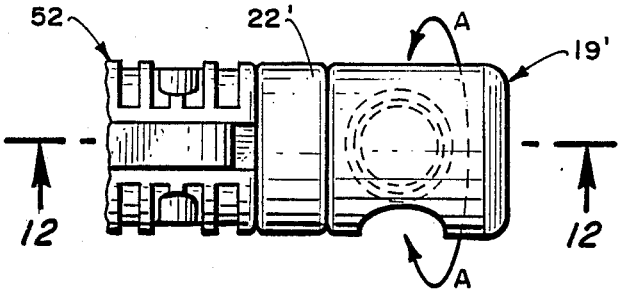
FIG. 11 is a fragmentary top plan view of a modified end cap with a valve means in closed position.
Figure 12:
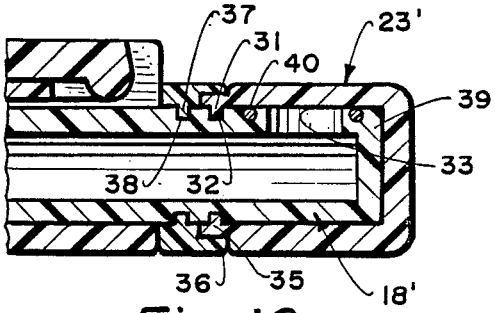
FIG. 12 is a cross-sectional view taken along lines 12—12 of FIG. 11.
Figure 13:
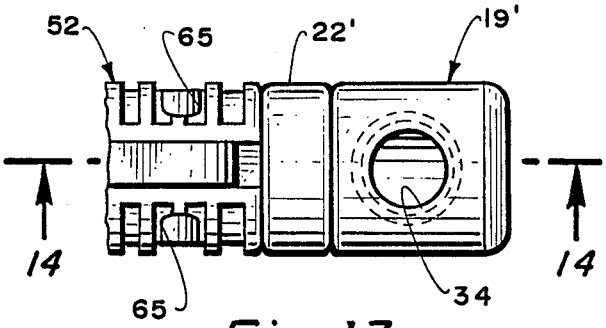
FIG. 13 is a fragmentary top plan view of the end cap shown in FIG. 11 in an open position.
Figure 14:
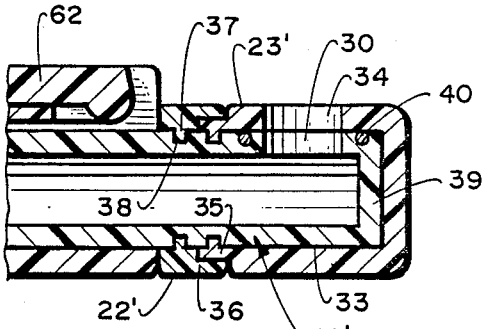
FIG. 14 is a cross-sectional view taken along lines 14—14 of FIG. 13.

The skirt end 23' of cap 19' includes a retention means shown as inner detent 31. The detent engages a corresponding first annular recess 32 in the extended end. This connection allows the cap to be rotated, as shown by arrows A, in either direction. Skirt opening 34 can thereby be moved into and out of correspondence with side opening 30 for providing access to the rod member interior. FIGS. 11 and 12 show the valve in a closed position and FIGS. 13 and 14 show the openings in correspondence for a valve open position.

To facilitate a good seal, the skirt 23' is provided with an indented portion 35 which is constrained by annular flange 36 of abutment ring 22'. The abutment ring is releasably attached to end 18' via ring detent 37 which interfits with second annular recess 38 of the rod member. It is expected that the ring and cap will be constructed of resilient materials such as plastic that will allow the above parts to be snap-fitted together.

In a similar fashion, second abutment ring 22 has an inner projection 42 which releasably engages an annular notch 43. Thus, when second closure cap 19 is removed from second end 18, the ring 22 can be removed by forcing projection 42 out of notch 43. The ring may be split to accomodate this purpose. With the above parts removed, hand grip sleeves and other massage sleeve means can be slid upon the rod member.

Referring back to FIGS. 1–6, the first and second gripping sleeves are shown generally by reference numerals 50,52. They each have a longitudinal sleeve opening 54 throughout their length. The openings have a cross-sectional shape in close correspondence with the exterior cross-sectional shape of the rod member. This permits a smooth rotational engagement therebetween.

The sleeve length proximates the width of a users hand and should be about less than one third the length of the rod member. Gripping means shown as ribs 56 may be used and the overall exterior shape may be oblong or egg-shaped to facilitate firm manual grasping.

The sleeves include heat insulative means whereby they are constructed of heat insulative materials. Any one or combination of plastic, wood or rubber is useful. The air gaps 57 between the ribs also function as heat insulative means.

Note that the ribs 56 comprise parallelly extending mirror-image arcuate segments on opposing sides of each sleeve. In the first gripping sleeve, the segments terminate at a solid upper ridge portion 58. The ridge portion has a quadrilateral cross-sectional shape with a flat upper surface 59. It extends longitudinally along the length of the gripping sleeve parallel to the concentric longitudinal axes of the sleeve and rod member.

The second gripping sleeve 52 has an exterior appearance substantially similar to first gripping sleeve 50. However, the ridge upper surface 59 is indented to form a recess 60. A handle means shown as elongated bar 62 is sized to fit within the recess. The proximal end of the bar is provided with cross pin 64 which extends through the bar and into pin openings 65 on opposing sides of the recess at the sleeve outer end. In this way, the bar is pivotally attached to the sleeve in an unobtrusive manner that doesn't detract from the overall sleeve appearance.

Figure 6:
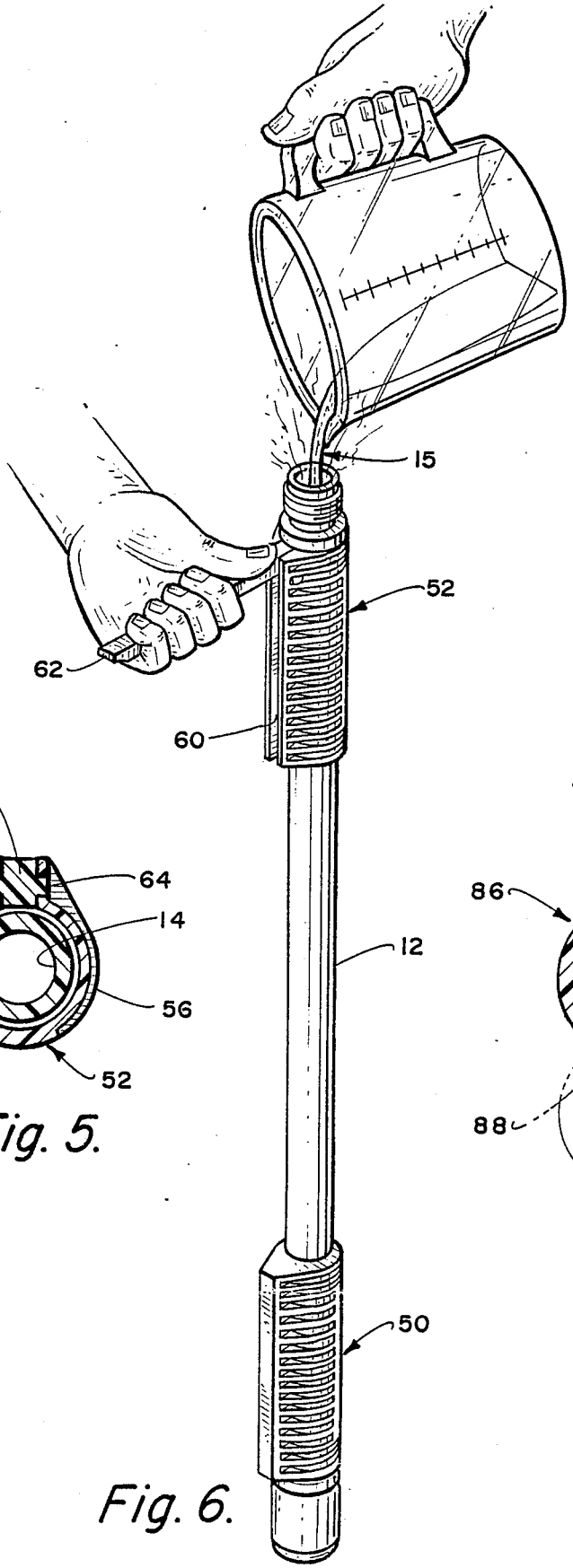
FIG. 6 is an illustration showing the device of FIG. 1 being filled with a hot fluid.
Figure 5:
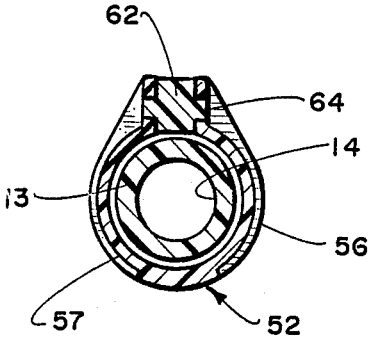
FIG. 5 is a cross-sectional view taken along lines 5—5 of FIG. 4.

In use, one simply engages free end 66 of the bar and lifts it as shown by arrows B in FIG. 1. While grasping the bar, the overall device may be raised and supported in an upright manner for filling with a measured amount of thermal medium as shown in FIG. 6. In this position, the second closure cap will be removed and first gripping sleeve 50 rests by gravity against first abutment ring 21. The second gripping sleeve abuts against the second abutment ring which thereby upholds the overall assembly for safe convenient filling.

It will be appreciated that other handle means may be connected to an end of the rod member for offsetting support thereof. Such support is important to avoid contact with possible spillage of hot thermal medium materials. For example, a separate yoke handle or noose means may be used to engage the second abutment ring. These embodiments, however, are less convenient since they are not readily built into the device.

Figure 15:
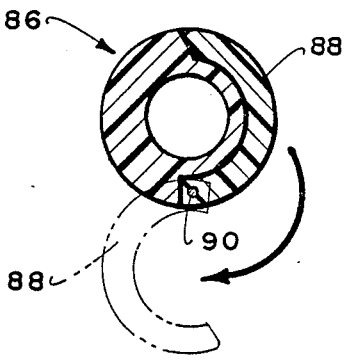
FIG. 15 is a top plan view of an alternative abutment ring with a handle means.

FIG. 15 illustrates an alternative abutment ring 86 which attaches to the rod member second end via the detent means described with respect to the second abutment ring 22. In this case, the ring includes a separate handle segment 88 which comprises about one half of the ring thickness and extends over about one half of the ring circumference. One end of the segment is provided with a pivot pin 90 that connects it to the underlying ring structure. In use, the handle segment is swung outwardly, as shown by arrow C, to allow a user to grasp it and support the device during filling.

The portion of the rod member length that is exposed between the spaced-apart gripping sleeves defines massage area 70. As a user grasps the sleeves and moves the massage area across ones skin, the rod member will rotate within openings 54. This massaging action, plus the heat that is transferred from the rod member, provides a pleasing and effective massage effect.

Figure 7:
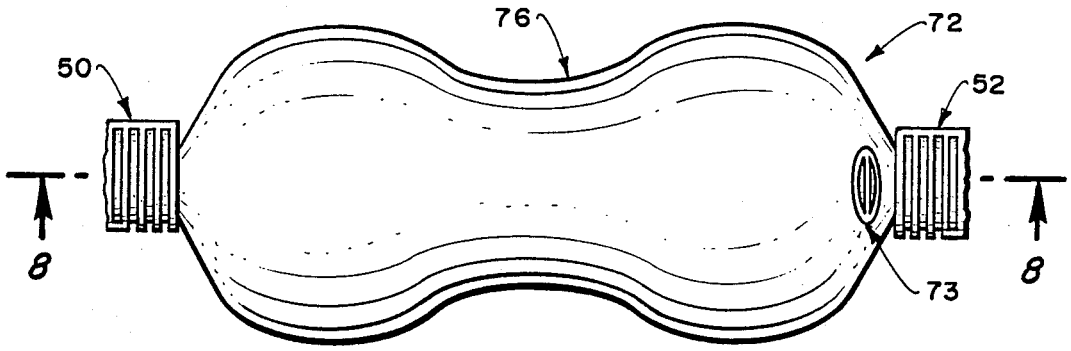
FIG. 7 is a top plan view of a thermal roller sleeve adapted for use with the device of FIG. 1.
Figure 8:
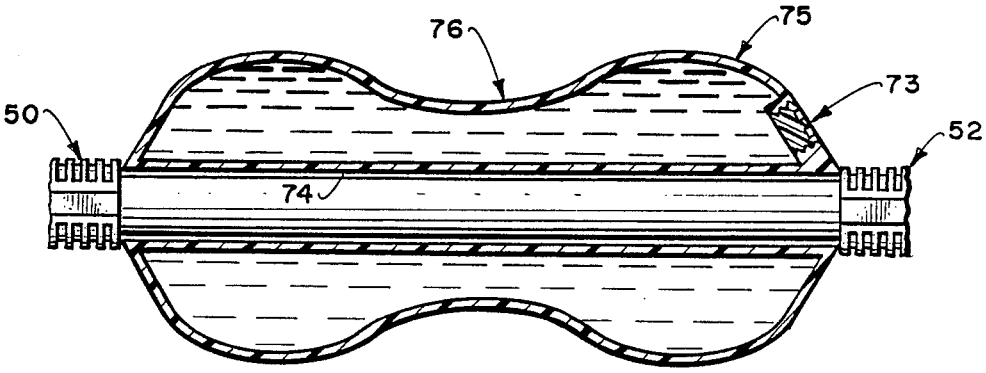
FIG. 8 is a cross-sectional view taken along lines 8—8 of FIG. 7.

To enhance the massaging action for specific purposes, the invention is readily adaptable for use with accessory massage sleeve means. A sealed double-walled body 72 is shown in FIGS. 7 and 8. It is provided with a resealable fill opening and closure means 73 for containing a thermal medium. The body includes an inner wall 74 defining a slide opening for the rod member in the same manner as with grip sleeve openings 54. The length of the inner wall proximates the length of massage area 70. The outer wall 75 includes a concave annular mid-portion 76 which renders the sleeve body more suitable for spinal massaging.

Figure 9:
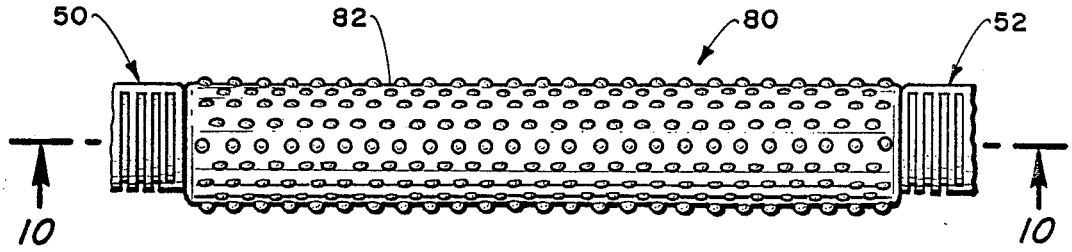
FIG. 9 is a top plan view of an uneven-surfaced sleeve adapted for use with the device of FIG. 1.
Figure 10:
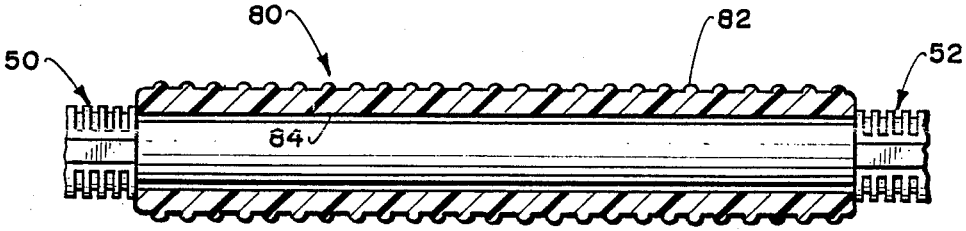
FIG. 10 is a cross-sectional view taken along lines 10—10 of FIG. 9.

A basic massage sleeve 80 with roughened exterior surface 82 is shown in FIGS. 9 and 10. The sleeve inner wall 84 defines a slide opening for the rod member. The wall length preferably proximates the massage area length or, if multiple sleeve are used, the combined length should equal the massage area length.

While the invention has been described with respect to preferred embodiments, it will be apparent that various modifications may be made without departing from the scope and spirit of the invention. Accordingly, it is to be understood that the invention is not to be limited by the specific illustrative embodiments, but only by the scope of the appended claims.

I claim:

1. A thermal massage device comprising:

an elongated member having a hollow interior containing a thermal medium, said member having a first end sealed with a first closure means and a second end sealed with a second closure means;

a first gripping sleeve slidably encircling said member proximate said first end;

a second gripping sleeve slidably encircling said member proximate said second end; and, handle means adjacent said second end for manually supporting said device comprising an elongated bar pivotally attached to said second gripping sleeve.

2. The device of claim 1 wherein said second gripping sleeve includes an elongated recess for retaining said bar when not in use.

3. The device of claim 1 wherein said second closure means includes a second closure cap having retention means for connection to said second end.

4. The device of claim 3 wherein said second end includes end threads and said retention means comprises corresponding threads for engagement with said end threads.

5. The device of claim 3 wherein said second end includes a side opening and said closure cap includes a cap opening, said cap being rotatable about said second end to selectively align said cap opening with said side opening.

6. The device of claim 1 including a massage sleeve means slidably encircling said hollow member between said first and second gripping sleeves.

7. The device of claim 6 wherein said massage sleeve means comprises a sealed double-walled body having a resealable fill opening and closure means.

8. The device of claim 6 wherein said massage sleeve means is provided with an irregular exterior surface.

9. A thermal massage device comprising:

an elongated member with a hollow interior having opposing ends enclosed with sealing caps, gripping sleeves slidably encircling said member proximate said caps with the length of said member between said sleeves defining a massage area, the wall of said member capable of transferring heat from a thermal medium contained within said interior, at least one of said opposing ends having a handle means for offsetting manual support of said device during filling with said thermal medium, said handle means comprising an elongated bar pivotally attached to one of said gripping sleeves.

10. The device of claim 9 wherein one of said sealing caps includes valve means for permitting access to said interior.

11. The device of claim 9 wherein at least one of said sealing caps is removable for permitting access to said interior.

12. The device of claim 9 including a massage sleeve means slidably encircling at least a portion of said massage area.

13. The device of claim 12 wherein said massage sleeve means comprises a sealed double-walled body having a resealable fill opening and closure means.

14. The device of claim 12 wherein said massage sleeve means is provided with an irregular exterior surface.

15. The device of claim 9 wherein said sealing caps include an interior chamber for holding additional quantities of said thermal medium.

16. The device of claim 9 wherein said gripping sleeves include heat insulative means.

17. A thermal massage device comprising:

an elongated member having a hollow interior containing a thermal medium, said member having a first end sealed with a first closure means and a second end sealed with a second closure means, an abutment ring encircling said elongated member adjacent said second end;

a first gripping sleeve slidably encircling said member proximate said first end;

a second gripping sleeve slidably encircling said member proximate said second end; and, handle means pivotally attached to said abutment ring adjacent said second end for manually supporting said device, said handle means comprising an outwardly movable segment of said ring.

* * * * *